United States Patent [19]

Matsuno et al.

[11] Patent Number: 5,049,357

[45] Date of Patent: Sep. 17, 1991

[54] METHOD FOR MANUFACTURING IRON-BORON-SILICON ALLOY

[75] Inventors: Hidetoshi Matsuno; Toshio Takaoka; Yoshiteru Kikuchi; Yoshihiko Kawai; Tadahiko Nishi, all of Tokyo, Japan

[73] Assignee: NKK Corporation, Tokyo, Japan

[21] Appl. No.: 427,129

[22] PCT Filed: Apr. 4, 1989

[86] PCT No.: PCT/JP89/00361

§ 371 Date: Oct. 16, 1989

§ 102(e) Date: Oct. 6, 1989

[87] PCT Pub. No.: WO89/09842

PCT Pub. Date: Oct. 19, 1989

[30] Foreign Application Priority Data

Apr. 5, 1988 [JP] Japan ..... 63-83492

[51] Int. Cl.[5] ..... C22C 33/04

[52] U.S. Cl. ..... 420/581; 75/532; 420/14; 420/121

[58] Field of Search ..... 420/581, 14, 121; 75/532, 534

[56] References Cited

U.S. PATENT DOCUMENTS 4,572,747 2/1986 Sussman et al. ..... 420/121
4,602,948 7/1986 Singhal .
4,602,950 7/1986 Singhal et al. .
4,602,951 7/1986 Singhal .

FOREIGN PATENT DOCUMENTS 0156459 10/1985 European Pat. Off. .
3529083 5/1986 Fed. Rep. of Germany .
174355 8/1986 Japan .
2155494 9/1985 United Kingdom .

*Primary Examiner*—Melvyn J. Andrews
*Attorney, Agent, or Firm*—Frishauf, Holtz, Goodman & Woodward

[57] ABSTRACT

A method for economically manufacturing an iron-boron-silicon alloy through simple steps, which comprises the steps of: adding a boron raw material and a carbonaceous reducing agent to a molten iron received in a vessel; blowing oxygen gas into the molten iron to reduce the boron raw material in the molten iron by means of the carbonaceous reducing agent to prepare a boron-containing molten iron; continuing the blowing of oxygen gas to decarburize the boron-containing molten iron until the carbon content in the boron-containing molten iron decreases to up to 0.2 wt. %; and adding at least one of silicon and ferrosilicon to the boron-containing molten iron while stirring the boron-containing molten iron, thereby manufacturing an iron-boron-silicon alloy.

9 Claims, 1 Drawing Sheet

METHOD FOR MANUFACTURING IRON-BORON-SILICON ALLOY

FIELD OF THE INVENTION

The present invention relates to a method for manufacturing an iron-boron-silicon alloy containing, for example, 3 wt. % boron and 5 wt. % silicon.

BACKGROUND OF THE INVENTION

An iron-boron-silicon amorphous alloy containing, for example, 3 wt. % boron and 5 wt. % silicon has a high magnetic permeability and is widely applied as a magnetic material. Such an iron-boron-silicon amorphous alloy is obtained by supplying a molten iron-boron-silicon alloy containing 3 wt. % boron and 5 wt. % silicon onto the surface, for example, of a cooling rotary drum rotating at a prescribed circumferential speed, and rapidly cooling the molten alloy to solidify same into a thin sheet shape.

The above-mentioned iron-boron-silicon alloy is conventionally manufactured as follows: Into an electric furnace are charged, at prescribed ratios, a boron raw material comprising at least one of a boron ore such as a sodium borate ore a calcium borate ore or a colemanite ore, and a boric acid obtained by treating the above-mentioned boron ore by an acid, an iron-bearing source such as an iron ore or a scrap, and a carbonaceous reducing agent such as coke or coal. This charge is melted and refined in the electric furnace, and then solidified to prepare a solid iron-boron alloy, i.e., a ferroboron. Then, the thus prepared solid ferroboron and at least one of separately prepared solid silicon and ferrosilicon are added at prescribed ratios to a molten iron having a carbon content of up to 0.2 wt. % received in a melting furnace, and the mixture is melted, thereby manufacturing an iron-boron-silicon alloy.

The above-mentioned conventional method for manufacturing an iron-boron-silicon alloy has the following problem: The conventional manufacturing method comprises the preparing step of ferroboron in the electric furnace and the melting step of ferroboron and silicon into the molten iron in the melting furnace. The conventional manufacturing method is therefore complicated and requires much electric energy, resulting in an increased manufacturing cost of the iron-boron-silicon alloy.

Under such circumstances, there is a strong demand for the development of a method for economically manufacturing an iron-boron-silicon alloy through simple steps without requiring much electric energy, but such a method has not as yet been proposed.

SUMMARY OF THE INVENTION

An object of the present invention is therefore to provide a method for economically manufacturing an iron-boron-silicon alloy through simple steps without requiring much electric energy.

In accordance with one of the features of the present invention, there is provided a method for manufacturing an iron-boron-silicon alloy, characterized by comprising the steps of:

adding a boron raw material comprising at least one of a boron ore and a boric acid, and a carbonaceous reducing agent to a molten iron received in a vessel;

blowing oxygen gas into said molten iron to keep said molten iron at a constant temperature through combustion of part of said carbonaceous reducing agent, and reducing said boron raw material in said molten iron by means of the balance of said carbonaceous reducing agent to prepare a boron-containing molten iron;

continuing said blowing of oxygen gas to decarburize said boron-containing molten iron until the carbon content in said boron-containing molten iron decreases to up to 0.2 wt. %; and adding at least one of silicon and ferrosilicon to said boron-containing molten iron while stirring said boron-containing molten iron, thereby manufacturing an iron-boron-silicon alloy.

DETAILED DESCRIPTION OF PREFERRED EMBODIMENTS

From the above-mentioned point of view, extensive studies were carried out for the purpose of developing a method for economically manufacturing an iron-boron-silicon alloy through simple steps without requiring much electric energy. As a result, the following finding was obtained: It is possible to economically manufacture an iron-boron-silicon alloy through simple steps without requiring much electric energy, by adding a boron raw material comprising at least one of a boron ore and a boric acid, and a carbonaceous reducing agent to a molten iron received in a vessel; blowing oxygen gas into the molten iron to reduce the boron raw material in the molten iron by means of the carbonaceous reducing agent to prepare a boron-containing molten iron; continuing the blowing of the oxygen gas to decarburize the boron-containing molten iron until the carbon content in the boron-containing molten iron decreases to up to 0.2 wt. %; and adding at least one of silicon and ferrosilicon to the boron-containing molten iron.

The present invention was made on the basis of the above-mentioned finding. The method for manufacturing an iron-boron-silicon alloy of the present invention is described below with reference to the drawings.

Figure 1:
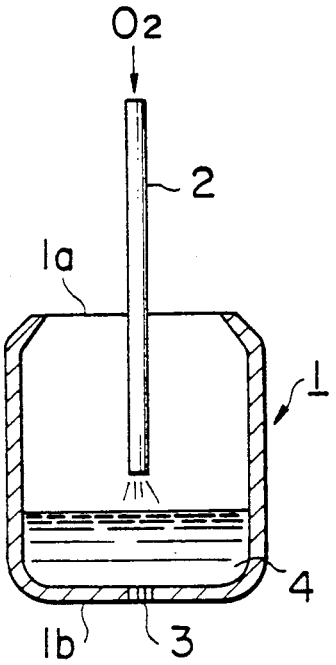
FIG. 1 is a schematic vertical sectional view of a vessel, illustrating the preparing step of a boron-containing molten iron in a first embodiment of the method of the present invention.
Figure 2:
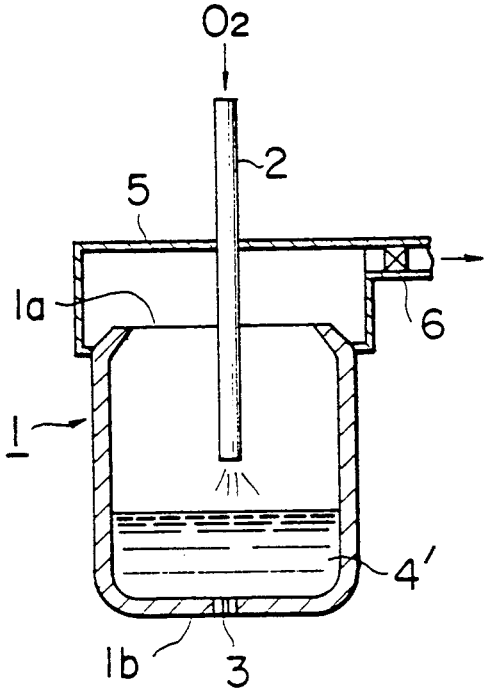
FIG. 2 is a schematic vertical sectional view of the vessel, illustrating the decarburizing step of the boron-containing molten iron in the first embodiment of the method of the present invention.

FIG. 1 is a schematic vertical sectional view of a vessel, illustrating the preparing step of a boron-containing molten iron in a first embodiment of the method of the present invention, and FIG. 2 is a schematic vertical sectional view of the vessel, illustrating the decarburizing step of the boron-containing molten iron in the first embodiment of the method of the present invention. In the first embodiment of the method of the present invention, a known converter 1 is used as a vessel as shown in FIGS. 1 and 2. A molten iron 4 is received in the converter 1. A boron raw material in a prescribed amount and a carbonaceous reducing agent in a prescribed amount are added to the molten iron 4 received in the converter 1.

As the boron raw material, at least one of a boron ore such as a sodium borate ore, a calcium borate ore or a colemanite ore, and a boric acid such as boric anhydride ($B_2O_3$) and hydrated boric acid ($H_3BO_3$) is used. As the carbonaceous reducing agent, at least one of coke and coal is employed.

A lance 2 is inserted substantially vertically from above through a furnace mouth 1*a* into the converter 1, and oxygen gas is blown through the lance 2 at a position apart upward by a prescribed distance from the surface of the molten iron 4 onto the surface of the molten iron 4. Furthermore, at least one of oxygen gas, nitrogen gas, argon gas, $CO_2$ gas and hydrocarbon gas is blown into the molten iron 4 in the converter 1 through a porous plug 3 provided in a gas blowing port of a furnace bottom 1*b* of the converter 1.

The molten iron 4 in the converter 1 is stirred by oxygen gas blown through the lance 2 and at least one of oxygen gas, nitrogen gas, argon gas, $CO_2$ gas and hydrocarbon gas blown through the plug 3 as described above, and part of the carbonaceous reducing agent added to the molten iron 4 is burnt by the oxygen gas blown as above. This combustion of part of the carbonaceous reducing agent keeps the molten iron at a constant temperature. The boron raw material in the molten iron 4 is reduced by the balance of the carbonaceous reducing agent to prepare a boron-containing molten iron 4'.

The boron raw material and the carbonaceous reducing agent may be added from the furnace mouth 1*a* into the molten iron 4 in the converter 1 before or during the blowing of oxygen gas, or may be added through the lance 2 together with oxygen gas.

Subsequently, the lance 2 is removed from the converter 1. Then, as shown in FIG. 2, the furnace mouth 1*a* of the converter 1 is air-tightly covered by a hood 5, and the lance 2 is substantially vertically inserted again from above into the converter 1 through a lance insertion hole provided in the hood 5. Then, the pressure in the converter 1 is reduced by sucking the gases in the converter 1 through a duct 6 provided in the hood 5.

Oxygen gas is blown again through the lance 2 onto the surface of the boron-containing molten iron 4' in the converter 1 thus kept under a decreased pressure. Oxygen gas is further blown through the plug 3 provided in the gas blowing port of the furnace bottom 1*b* of the converter 1 into the boron-containing molten iron 4' in the converter 1 kept under a decreased pressure.

By continuing the blowing of oxygen gas into the boron-containing molten iron 4' through the lance 2 and the plug 3 as described above, the boron-containing molten iron 4' is decarburized until the carbon content therein decreases to up to 0.2 wt. %. In this case, if stirring of the boron-containing molten iron 4' is promoted by blowing an inert gas such as nitrogen gas or argon gas through the plug 3 as required, the above-mentioned decarburization of the boron-containing molten iron 4' can be accomplished more effectively. Since the above-mentioned decarburization of the boron-containing molten iron 4' by oxygen gas in the converter 1 is conducted under a decreased pressure, CO gas produced during decarburization is efficiently discharged from the boron-containing molten iron 4'. It is therefore possible to minimize the quantity of oxidation of boron in the boron-containing molten iron 4'.

Decarburization of the boron-containing molten iron 4' under a decreased pressure may be accomplished by any of the various conventional decreased-pressure decarburization methods, in addition to the method as mentioned above.

After removing the lance 2 from the converter 1, the hood 5 covering the furnace mouth 1*a* of the converter 1 is removed, and at least one of silicon in a prescribed amount and ferrosilicon in a prescribed amount is added through the furnace mouth 1*a* to the boron-containing molten iron 4' having a carbon content of up to 0.2 wt. % in the converter 1. The boron-containing molten iron 4' is stirred, on the other hand, by blowing an inert gas such as nitrogen gas and argon gas into the boron-containing molten iron 4' in the converter 1 through the plug 3 on the furnace bottom 1*b* of the converter 1, whereby an iron-boron-silicon alloy is manufactured.

Figure 3:
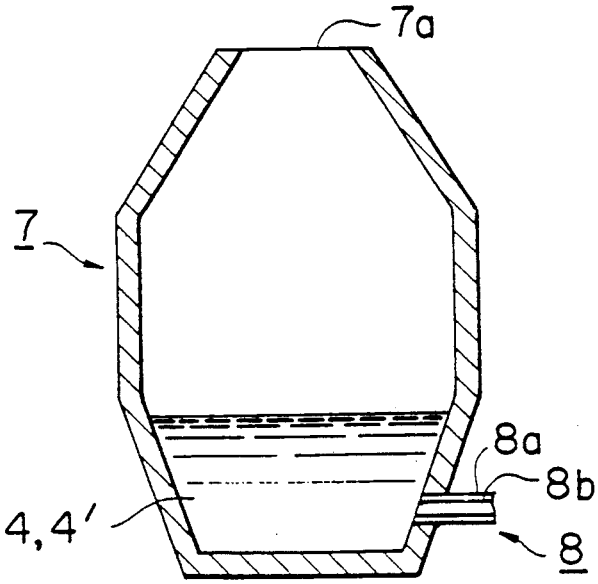
FIG. 3 is a schematic vertical sectional view of a vessel, illustrating a second embodiment of the method of the present invention.

FIG. 3 is a schematic vertical sectional view of a vessel, illustrating a second embodiment of the method of the present invention. In the second embodiment of the method of the present invention, a known AOD furnace (an abbreviation of "argon oxygen decarburization" furnace) 7 as shown in FIG. 3 is used as the vessel. A dual-pipe nozzle 8, in which an inner pipe 8*b* is concentrically inserted into an outer pipe 8*a*, is substantially horizontally provided in a gas blowing port at a lower portion of a side wall of the AOD furnace 7. Oxygen gas and/or an inert gas such as argon gas, helium gas or nitrogen gas are blown into the AOD furnace 7 through the inner pipe 8*b* of the nozzle 8, and only the above-mentioned inert gas is blown through the outer pipe 8*a* of the nozzle 8, for the purpose of preventing a damage to the inner pipe 8*b* resulting from overheating.

A molten iron 4 is received in the AOD furnace 7. The above-mentioned boron raw material in a prescribed amount and the above-mentioned carbonaceous reducing agent in a prescribed amount are added to the molten iron 4 thus received in the AOD furnace 7 through a furnace mouth 7*a*.

Oxygen gas and an inert gas are blown through the nozzle 8 into the molten iron 4 in the AOD furnace 7. The molten iron 4 in the AOD furnace 7 is stirred by oxygen gas and the inert gas thus blown through the nozzle 8, and part of the carbonaceous reducing agent added to the molten iron 4 is burnt by oxygen gas blown as above. This combustion of part of the carbonaceous reducing agent keeps the molten iron 4 at a constant temperature. The boron raw material in the molten iron 4 is reduced by the balance of the carbonaceous reducing agent to prepare a boron-containing molten iron 4'.

By further continuing the blowing of oxygen gas and the inert gas into the boron-containing molten iron 4' through the nozzle 8, the boron-containing molten iron 4' is decarburized until the carbon content therein decreases to up to 0.2 wt. %. Since the above-mentioned decarburization of the boron-containing molten iron 4' by oxygen gas in the AOD furnace 7 is accomplished while blowing the inert gas together with oxygen gas into the boron-containing is diluted by the inert gas and efficiently discharged from the boron-containing molten iron 4'. It is therefore possible to minimize the quantity of oxidation of boron in the boron-containing molten iron 4'.

During the above-mentioned reduction of the boron raw material in the molten iron 4, simultaneously with the blowing of oxygen gas and the inert gas through the nozzle 8, oxygen gas may be blown onto the surface of the molten iron 4 through a lance (not shown) inserted substantially vertically from above through the furnace mouth 7*a* into the AOD furnace 7.

Then, at least one of silicon in a prescribed amount and ferrosilicon in a prescribed amount is added through the furnace mouth 7*a* to the boron-containing molten iron 4' having a carbon content of up to 0.2 wt. % in the AOD furnace 7. The boron-containing molten iron 4' is stirred, on the other hand, by blowing only the inert gas into the boron-containing molten iron 4' in the AOD furnace 7 through the nozzle 8, whereby an iron-boron-silicon alloy is manufactured.

Now, the method of the present invention is described in more detail by means of examples.

EXAMPLE 1

Boric anhydride ($B_2O_3$) was used as the boron raw material, and coke was employed as the carbonaceous reducing agent. A molten iron 4 previously applied with a dephosphorizing treatment and a desulfurizing treatment and having the chemical composition as shown in the following Table 1 was received in an amount of 5 tons in the converter 1 shown in FIG. 1.

TABLE 1

| | | | | (wt. %) | | | |
|---|---|---|---|---|---|---|---|
| C | B | Si | P | S | Mn | N | Fe |
| 4.5 | under 0.001 | 0.2 | 0.008 | 0.003 | 0.10 | 0.0029 | balance |

Boric anhydride in an amount of 145 kg per ton of molten iron and coke in an amount of 410 kg per ton of molten iron were added to the molten iron 4 received in the converter 1. Then, oxygen gas was blown into the molten iron 4 in the converter 1 through the lance 2 and the plug 3 at a flow rate of 2,000 $Nm^3$/hr for about 45 minutes. Part of boric anhydride and coke was added through the furnace mouth 1*a* to the molten iron 4 in the converter 1 before the blowing of oxygen gas, and the balance of boric anhydride and coke was pulverized into powder which was blown into the molten iron 4 in the converter I together with oxygen gas through the lance 2. The chemical composition of the thus prepared boron-containing molten iron 4' is shown in Table 2.

TABLE 2

| | | | | (wt. %) | | | |
|---|---|---|---|---|---|---|---|
| C | B | Si | P | S | Mn | N | Fe |
| 4.5 | 3.0 | 0.1 | 0.029 | 0.001 | 0.11 | 0.0010 | balance |

Subsequently, the lance 2 was removed from the converter 1. Then, as shown in FIG. 2, the furnace mouth 1*a* of the converter 1 was air-tightly covered by the hood 5, and the lance 2 was substantially vertically inserted again from above into the converter 1 through the lance insertion hole provided in the hood 5. Then, the gases in the converter 1 were sucked through the duct 6 provided in the hood 5 to reduce the pressure in the converter 1 to 50 Torr. Oxygen gas was blown again through the lance 2 and the plug 3 into the boron-containing molten iron 4' in the converter 1 thus kept under a decreased pressure for about 90 minutes while gradually decreasing the flow rate of oxygen gas from 800 to 200 $Nm^3$/hr to decarburize the boron-containing molten iron 4'.

The chemical composition of the thus decarburized boron-containing molten iron 4' is shown in Table 3.

TABLE 3

| | | | | (wt. %) | | | |
|---|---|---|---|---|---|---|---|
| C | B | Si | P | S | Mn | N | Fe |
| 0.05 | 2.8 | under 0.1 | 0.030 | 0.001 | 0.09 | 0.0009 | balance |

Subsequently, after removing the lance 2 from the converter 1, the hood 5 covering the furnace mouth 1*a* of the converter 1 was removed, and ferrosilicon containing 75 wt. % silicon was added in an amount of 72 kg per ton of molten iron through the furnace mouth 1*a* to the thus decarburized boron-containing molten iron 4' in the converter 1. Then, the contents of boron and other constituent elements of the boron-containing molten iron 4' were further adjusted, while argon gas was blown through the plug 3 on the furnace bottom 1*b* of the converter 1 into the boron-containing molten iron 4' in the converter 1 at a flow rate of 50 $Nm^3$/hr to stir the boron-containing molten iron 4'.

Thus, an iron-boron-silicon alloy having the chemical composition as shown in Table 4 was obtained.

TABLE 4

| | | | | (wt. %) | | | |
|---|---|---|---|---|---|---|---|
| C | B | Si | P | S | Mn | N | Fe |
| 0.05 | 3.0 | 5.0 | 0.028 | 0.001 | 0.10 | 0.0013 | balance |

EXAMPLE 2

A high purity molten iron 4 previously applied with a decarburizing treatment, a dephosphorizing treatment and a desulfurizing treatment and having the chemical composition as shown in the following Table 5 was received in an amount of 5 tons in the converter 1 shown in FIG. 1.

TABLE 5

| | | | | (wt. %) | | | |
|---|---|---|---|---|---|---|---|
| C | B | Si | P | S | Mn | N | Fe |
| 0.005 | under 0.001 | 0.01 | 0.002 | 0.001 | 0.03 | 0.0031 | balance |

Boric anhydride in an amount of 130 kg per ton of molten iron and coke in an amount of 410 kg per ton of molten iron were added to the molten iron 4 received in the converter 1. Then, into the molten iron 4 in the converter 1, oxygen gas was blown through the lance 2 at a flow rate of 2,000 $Nm^3$/hr, and argon gas was blown through the plug 3 at a flow rate of 120 $Nm^3$/hr. Oxygen gas and argon gas were blown for about 40 minutes. Part of boric anhydride and coke was added through the furnace mouth 1*a* to the molten iron 4 in the converter 1 before the blowing of oxygen gas and argon gas, and the balance of boric anhydride and coke was added through the furnace mouth 1*a* to the molten iron 4 in the converter 1 during the blowing of oxygen was and argon gas.

The chemical composition of the thus prepared boron-containing molten iron 4' is shown in Table 6.

TABLE 6

| | | | | (wt. %) | | | |
|---|---|---|---|---|---|---|---|
| C | B | Si | P | S | Mn | N | Fe |
| 4.4 | 3.1 | 0.1 | 0.020 | under 0.001 | 0.02 | 0.0007 | balance |

Subsequently, the lance 2 was removed from the converter 1. Then, as shown in FIG. 2, the furnace mouth 1*a* of the converter 1 was air-tightly covered by the hood 5, and the lance 2 was substantially vertically inserted again from above into the converter 1 through the lance insertion hole provided in the hood 5. Then, the gases in the converter 1 were sucked through the duct 6 provided in the hood 5 to reduce the pressure in the converter 1 to 50 Torr. Oxygen gas was blown again through the lance 2 into the boron-containing molten iron 4' in the converter 1 thus kept under a decreased pressure for about 100 minutes while gradually decreasing the flow rate of oxygen gas from 800 to 200 $Nm^3/hr$ to decarburize the boron-containing molten iron 4'.

The chemical composition of the thus decarburized boron-containing molten iron 4' is shown in Table 7.

TABLE 7

| | | | | (wt. %) | | | |
|---|---|---|---|---|---|---|---|
| C | B | Si | P | S | Mn | N | Fe |
| 0.05 | 2.9 | 0.02 | 0.020 | under 0.001 | 0.02 | 0.0005 | balance |

Subsequently, after removing the lance 2 from the converter 1, the hood 5 covering the furnace mouth 1*a* of the converter 1 was removed, and ferrosilicon containing 75 wt. % silicon was added in an amount of 75 kg per ton of molten iron through the furnace mouth 1*a* to the thus decarburized boron-containing molten iron 4' in the converter 1. Then, the contents of boron and other constituent elements of the boron-containing molten iron 4' were further adjusted, while argon gas was blown through the plug 3 on the furnace bottom 1*b* of the converter 1 into the boron-containing molten iron 4' in the converter 1 at a flow rate of 150 $Nm^3/hr$ to stir the boron-containing molten iron 4'.

Thus, an iron-boron-silicon alloy having the chemical composition as shown in Table 8 was obtained.

TABLE 8

| | | | | (wt. %) | | | |
|---|---|---|---|---|---|---|---|
| C | B | Si | P | S | Mn | N | Fe |
| 0.04 | 2.8 | 4.9 | 0.019 | under 0.001 | 0.02 | 0.0009 | balance |

EXAMPLE 3

A molten iron 4 previously applied with a dephosphorizing treatment and a desulfurizing treatment and having the chemical composition as shown in the following Table 9 was received in an amount of 5 tons in the AOD furnace 7 shown in FIG. 3.

TABLE 9

| | | | | (wt. %) | | | |
|---|---|---|---|---|---|---|---|
| C | B | Si | P | S | Mn | N | Fe |
| 4.2 | under 0.001 | 0.02 | 0.010 | 0.009 | 0.18 | 0.0030 | balance |

Boric anhydride in an amount of 125 kg per ton of molten iron and coke in an amount of 390 kg per ton of molten iron were added to the molten iron 4 received in the AOD furnace 7. Then, oxygen gas at a flow rate of 1,000 $Nm^3/hr$ and argon gas at a flow rate of 350 $Nm^3/hr$ were blown through the nozzle 8 into the molten iron 4 in the AOD furnace 7 for about 85 minutes. Boric anhydride and coke were added to the molten iron 4 in the AOD furnace 7 through the furnace mouth 7*a* during the blowing of oxygen gas and argon gas.

The chemical composition of the thus prepared boron-containing molten iron 4' is shown in Table 10.

TABLE 10

| | | | | (wt. %) | | | |
|---|---|---|---|---|---|---|---|
| C | B | Si | P | S | Mn | N | Fe |
| 4.5 | 3.0 | 0.03 | 0.029 | 0.002 | 0.15 | 0.0011 | balance |

After discontinuing the addition of boric anhydride and coke to the molten iron 4, the blowing of oxygen gas and argon gas through the nozzle 8 was continued for about 115 minutes while gradually decreasing the flow rate of oxygen gas from 800 to 0 $Nm^3/hr$ and gradually increasing the flow rate of argon gas from 350 to 900 $Nm^3/hr$, to decarburize the boron-containing molten iron 4'.

The chemical composition of the thus decarburized boron-containing molten iron 4' is shown in Table 11.

TABLE 11

| | | | | (wt. %) | | | |
|---|---|---|---|---|---|---|---|
| C | B | Si | P | S | Mn | N | Fe |
| 0.09 | 2.8 | 0.01 | 0.030 | 0.002 | 0.08 | 0.0007 | balance |

Subsequently, ferrosilicon containing 75 wt. % was added in an amount of 76 kg per ton of molten iron through the furnace mouth 7*a* to the thus decarburized boron-containing molten iron 4' in the AOD furnace 7. Then, the contents of boron and other constituent elements of the boron-containing molten iron 4' were further adjusted, while argon gas was blown through the nozzle 8 into the boron-containing molten iron 4' in the AOD furnace 7 at a flow rate of 500 $Nm^3/hr$ to stir the boron-containing molten iron 4'.

Thus, an iron-boron-silicon alloy having the chemical composition as shown in Table 12 was obtained.

TABLE 12

| | | | | (wt. %) | | | |
|---|---|---|---|---|---|---|---|
| C | B | Si | P | S | Mn | N | Fe |
| 0.09 | 3.0 | 5.0 | 0.030 | 0.001 | 0.07 | 0.0011 | balance |

The above-mentioned Examples 1 to 3 cover cases of manufacturing an iron-boron-silicon alloy containing 3 wt. % boron and 5 wt. % silicon in all cases. The present invention is not however limited to these Examples 1 to 3, but is applicable, depending upon the use, to the manufacture of an iron-boron-silicon alloy containing boron and silicon in desired amounts.

According to the method of the present invention, as described above in detail, it is no longer necessary to previously prepare ferroboron in an electric furnace as in the conventional practice, but it is possible to economically manufacture an iron-boron-silicon alloy in a conventional converter or a conventional AOD furnace through simple steps without requiring much electric energy, thus providing industrially useful effects.

What is claimed is:

1. A method for manufacturing an iron-boron-silicon alloy, comprising the steps of:

adding a boron raw material comprising at least one of a boron ore and a boric acid, and a carbonaceous reducing agent to a molten iron in a vessel;

blowing oxygen gas into said molten iron to keep said molten iron at a constant temperature through combustion of part of said carbonaceous reducing agent, and reducing said boron raw material in said molten iron by means of the balance of said carbonaceous reducing agent to prepare a boron-containing molten iron;

continuing said blowing of oxygen gas to decarburize said boron-containing molten iron until the carbon content in said boron-containing molten iron decreases to 0.2 wt. % or less; and adding, after the completion of said blowing of oxygen gas at least one of silicon and ferrosilicon to said boron-containing molten iron while stirring said boron-containing molten iron, thereby manufacturing an iron-boron-silicon alloy.

2. The method as claimed in claim 1, wherein said decarburization of said boron-containing molten iron is carried out under a decreased pressure.

3. The method as claimed in claim 1, wherein said decarburization of said boron-containing molten iron is carried out while stirring said boron-containing molten iron.

4. The method as claimed in claim 2, wherein the boron raw material is selected from the group consisting of sodium borate ore, calcium borate ore, colemanite ore, boric anhydride and hydrated boric acid.

5. The method as claimed in claim 4, wherein the carbonaceous reducing agent is selected from the group consisting of coke and coal.

6. The method as claimed in claim 5, wherein said stirring is conducted by blowing an inert gas into the molten iron.

7. The method as claimed in claim 2, wherein the boron raw material is boric anhydride, the carbonaceous reducing agent is coke and ferrosilicon is added to the boron-containing molten iron.

8. The method as claimed in claim 3, wherein the boron raw material is selected from the group consisting of sodium borate ore, calcium borate ore, colemanite core, boric anhydride and hydrated boric acid.

9. The methods as claimed in claim 8, wherein the carbonaceous reducing agent is selected from the group consisting of coke and coal.

* * * * *